US011614287B2

(12) United States Patent
Darby

(10) Patent No.: US 11,614,287 B2
(45) Date of Patent: Mar. 28, 2023

(54) HEAT EXCHANGER

(71) Applicant: Darby Renewable Energy Design Systems Inc., Marion Bridge (CA)

(72) Inventor: Brian Roger Darby, Marion Bridge (CA)

(73) Assignee: Darby Renewable Energy Design Systems Inc., Marion Bridge (CA)

( * ) Notice: Subject to any disclaimer, the term of this patent is extended or adjusted under 35 U.S.C. 154(b) by 23 days.

(21) Appl. No.: 17/356,912

(22) Filed: Jun. 24, 2021

(65) Prior Publication Data

US 2022/0412659 A1 Dec. 29, 2022

(51) Int. Cl.
*F24H 3/02* (2022.01)
*F28D 7/10* (2006.01)

(52) U.S. Cl.
CPC ..... *F28D 7/10* (2013.01)

(58) Field of Classification Search
CPC ..... F28D 7/10; F28F 7/10
USPC ..... 165/154
See application file for complete search history.

(56) References Cited

U.S. PATENT DOCUMENTS 2,847,193 A 8/1958 Carter
3,279,028 A 10/1966 Hall et al.
4,186,796 A 2/1980 Usui
4,419,802 A * 12/1983 Riese ..... B21C 37/151 29/523
5,190,098 A 3/1993 Long
5,617,737 A 4/1997 Christensen et al.
5,940,987 A 8/1999 Stummer
7,261,143 B2 8/2007 Chen
7,438,122 B2 10/2008 Hawranek
7,543,630 B2 6/2009 Lai et al.
2001/0004009 A1 6/2001 Mackelvie
2007/0029066 A1 * 2/2007 Kidwell ..... F25B 30/06 165/45
2010/0243228 A1 * 9/2010 Price ..... F23J 15/06 165/185

(Continued)

FOREIGN PATENT DOCUMENTS

EP 0027845 B1 12/1984
JP H064221 Y2 * 2/1994
TW 1598560 B * 9/2017

OTHER PUBLICATIONS

"Double Walled Tube Heat Exchangers," 2 Pages, Retrieved from the Internet URL: [https://www.elancoheatexchangers.com/products/double-walled-tube-heat-exchangers/] on Jun. 29, 2022.

(Continued)

*Primary Examiner* — Davis D Hwu
(74) *Attorney, Agent, or Firm* — Borden Ladner Gervais LLP; Geoffrey deKleine

(57) ABSTRACT

A heat exchanger includes a plurality of tube assemblies. Each tube assembly includes an inner tube extending within an outer tube and configured for the flow of a first fluid therein. The inner tube and the outer tube are sized to facilitate capillary action fluid flow of a second fluid in an annular space between an outer surface of the inner tube and an inner surface of the outer tube, facilitating indirect heat exchange of the second fluid, through the inner tube and indirect heat exchange of the second fluid through the outer tube.

22 Claims, 10 Drawing Sheets

(56) References Cited

U.S. PATENT DOCUMENTS

2016/0131040 A1* 5/2016 Agg ..... F28D 7/024
60/785

OTHER PUBLICATIONS

"John Siegenthaler—Flow Energy . . . Don't Waste It. Taking Steps to Streamline and Optimize the Flow Within a Hydronic Design Contributes to the System's Overall Efficiency," 7 Pages, Mar. 25, 2021, Retrieved from the Internet URL:[https://www.hpacmag.com/features/flow-energy-dont-waste-it/?oly_enc_id=8797J4337467F2S] on Jul. 19, 2022.

Prayogo et al., "Investigation on Vertical Straight Wickless-heat Pipe as Gamma Irradiator Passive Cooling System," AIP Conference Proceedings 2255, Sep. 2020, vol. 2255 (1), 8 pages.

Sarraf, D.B., "Heat Pipe Heat Exchanger With Two Levels of Isolation for Environmental Control of Manned Spacecraft Crew Compartment," Advanced Cooling Technologies, Inc., 21 Pages, Retrieved from the Internet URL: [https://www.1-act.com/resources/tech-papers/heat-pipe-heat-exchanger-with-two-levels-of-isolation-for-environmental-control-of-manned-spacecraft-crew-compartment/] on Jun. 29, 2022.

"Wickless Heat Pipes: New Dynamics Exposed in a Near-weightless Environment," Rensselaer Polytechnic Institute, 3 Pages, Apr. 27, 2018, Retrieved from the Internet URL: [https://phys.org/news/2018-04-wickless-pipes-dynamics-exposed-near-weightless.html] on Jun. 29, 2022.

* cited by examiner

HEAT EXCHANGER

FIELD OF THE INVENTION

The present disclosure relates to heat exchangers that utilize heat exchange tubes in a variety of applications.

BACKGROUND

Heat exchangers are widely used in heating and cooling processes in which indirect heat exchange occurs between fluids separated by, for example, a heat exchange plate or tube wall.

Double pipe heat exchangers in which a central pipe extends within a second pipe are utilized because of their simplicity and ease of manufacturing and maintenance. These heat exchangers are used in a variety of heating and cooling applications. Double pipe heat exchangers include a first fluid flowing through a central pipe and a second fluid flowing through the space between the central pipe and the outer pipe.

These heat exchangers, however, suffer from inefficiency in heat exchange, leading to longer tubes and larger exchangers to provide sufficient heat exchange between fluids.

Improvements to heat exchangers are desirable.

SUMMARY

According to an aspect of an embodiment, a heat exchanger includes a plurality of tube assemblies. Each tube assembly includes an inner tube extending within an outer tube and configured for the flow of a first fluid therein. The inner tube and the outer tube are sized to promote capillary action fluid flow of a second fluid in an annular space between an outer surface of the inner tube and an inner surface of the outer tube, facilitating indirect heat exchange through the inner tube and indirect heat exchange through the outer tube.

According to another aspect of an embodiment, a tube assembly is provided for use in a heat exchanger. The tube assembly includes an inner tube and an outer tube. The inner tube extends within the outer tube and is configured for the flow of a first fluid therein. The inner tube and the outer tube are sized to promote capillary action fluid flow of a second fluid in an annular space, between an outer surface of the inner tube and an inner surface of the outer tube, facilitating indirect heat exchange through the inner tube and indirect heat exchange through the outer tube.

The first fluid may flow co-currently with the second fluid or countercurrent to the second fluid.

According to yet another aspect of an embodiment, a heat exchanger is provided. The heat exchanger includes a plurality of tube assemblies. Each tube assembly of the tube assemblies include an inner tube extending within an outer tube and configured for the flow of a first fluid therein. The inner tube and the outer tube are sized to promote capillary action fluid flow of a second fluid in an annular space between an outer surface of the inner tube and an inner surface of the outer tube. A first fluid supply is coupled to the inner tubes and a first fluid receiver is coupled to the inner tubes for the flow of the first fluid through the inner tubes. A second fluid supply is coupled to the outer tubes to supply the second fluid to the outer tubes and a second fluid receiver is coupled to the outer tubes to receive the second fluid therefrom. The tube assemblies are configured to facilitate indirect heat exchange through a wall of the inner tube and indirect heat exchange through a wall of the outer tube.

Advantageously, the second fluid supply, the second fluid receiver, and the outer tubes are all coupled in a closed loop system. The closed loop may include other outer tubes of a bank of tubes and may include other tubes of other banks of tubes. The second fluid, which may be saturated steam, circulates through the heat exchanger heating and reheating.

BRIEF DESCRIPTION OF THE DRAWINGS

Embodiments of the present invention will be described, by way of example, with reference to the drawings and to the following description, in which.

DETAILED DESCRIPTION OF EMBODIMENTS

Figure 1:
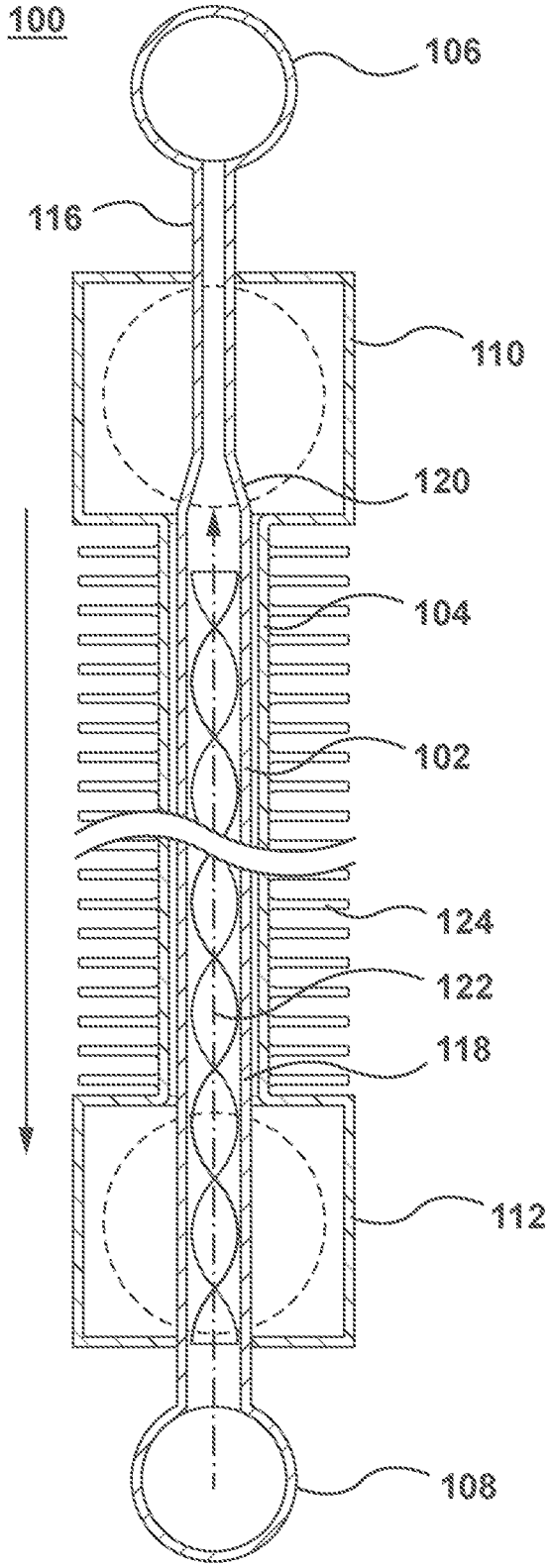
FIG. 1 is a sectional view through a tube assembly of a heat exchanger in accordance with an aspect of an embodiment.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

The disclosure generally relates to heat exchangers that include plurality of tube assemblies. Each tube assembly includes an inner tube extending within an outer tube and is configured for the flow of a first fluid therein. The inner tube and the outer tube are sized to promote capillary action fluid flow of a second fluid in an annular space between an outer surface of the inner tube and an inner surface of the outer tube, facilitating indirect heat exchange through the inner tube and indirect heat exchange through the outer tube.

Reference is made to FIG. 1, which shows one example of a tube assembly for use in a heat exchanger in accordance with an aspect of the present disclosure. The tube assembly is indicated generally by the numeral 100. The tube assembly 100 includes an inner tube 102 and an outer tube 104.

The inner tube 102 is fluidly connected at one end thereof to a fluid supply 106, and at an opposite end thereof to a fluid receiver 108. Thus, the inner tube 102 extends between the fluid supply 106 and the fluid receiver 108. In this example, the fluid supply 106 is shown coupled to an upper end of the inner tube 102 and the fluid receiver 108 coupled to the lower end of the inner tube 102. Alternatively, the fluid supply 106 may be coupled to a lower end of the inner tube 102 and the fluid receiver 108 coupled to an upper end of the inner tube 102.

The outer tube 104 is coupled at one end thereof to an upper header 110 and at a lower end thereof to a lower header 112. Thus, the outer tube 104 extends between the upper header 110 and the lower header 112 and fluidly couples the two.

In this example, the inner tube 102 includes a first section 116 that has a smaller diameter than a second section 118. Thus, the inner tube 102 includes a change in diameter between the smaller diameter first section 116 and the larger diameter second section 118. The change in diameter may be utilized, for example, to slow the flow of the fluid through the inner tube 102. The smaller diameter first section 116 is located above the larger diameter second section 118 and above the location at which the outer tube couples to the upper header 110. Thus, the smaller diameter first section 116 extends through the upper header 110 and extends from a top thereof. The larger diameter second section 118 extends through the lower header 108 and out a bottom thereof.

The inner tube 102 and the outer tube 104 are generally concentric and the larger diameter second section 118 of the inner tube 102 is sized relative to the outer tube 104 to provide an annular space or gap 114 between an outer surface of the inner tube 102 and an inner surface of the outer tube 104. Because the inner tube 102 and the outer tube 104 are generally concentric, the annular space or gap 114 is generally uniform around the larger diameter second section 118 of the inner tube 102 and along the length of the outer tube 104. The annular space or gap 114 is sized to facilitate capillary action fluid flow, which may be upwardly from the lower header 112, through the annular space or gap 114, and into the upper header 110. The gap size may be dependent on application and temperature. Regardless, the outer tube 104 is larger than the inner tube 102. For example, the outer tube may have an outside diameter of about 1" (25 mm) to about ¼" (6.35 mm). A gap of approximately ¼" (6.35 mm) to about 1/16" (1.5875 mm) exists around the inner tube 102, between the inner tube 102 and the outer tube 104.

The fluid supply 106 may be, for example, a part of a manifold. Similarly, the fluid receiver 108 may be part of a manifold. The fluid supply 106 is coupled to a fluid inlet for receiving a fluid from a fluid source. The fluid receiver 108 is coupled to a fluid outlet. Fluid that is provided to fluid supply 106 flows through the inner tube 102 to the fluid receiver 108. As indicated above, the fluid supply and fluid receiver may be reversed such that fluid may flow downwardly through the inner tube 102 or may flow upwardly through the inner tube 102. Optionally, the inner tube 102 may include one or more turbulence-inducing elements 122 therein to promote turbulent flow of fluid through the inner tube 102.

In the example shown in FIG. 1, fins 124 surround the outer tube 104 and extend outwardly therefrom to promote heat exchange with a surrounding atmosphere. Any suitable fins may be utilized, such as aluminum, stainless steel, copper or other materials to promote heat exchange, for example, with air or gasses moving over or around the fins 124.

Figure 2:
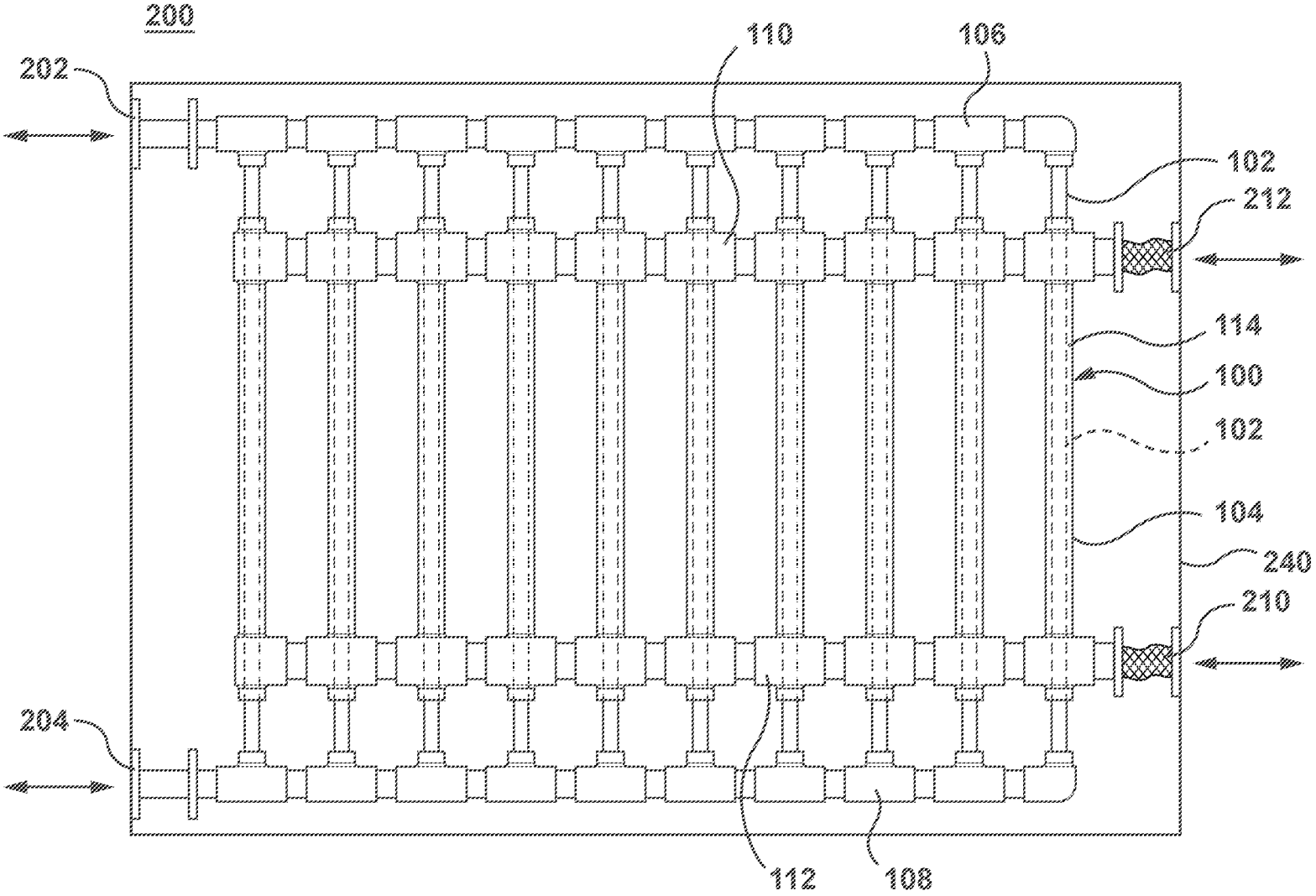
FIG. 2 is a front view of a heat exchanger in accordance with an aspect of an embodiment.

FIG. 2 shows a partial sectional front view of a heat exchanger 200 including tube assemblies such as the tube assemblies 100 described with reference to FIG. 1. The heat exchanger 200 in this example includes 10 tube assemblies 100. In the present example, the fluid supply is an upper manifold 106 that is fluidly connected to a top end of the 10 inner tubes 102. Similarly, the fluid receiver is a lower manifold 108 that is fluidly connected to a bottom end of the 10 inner tubes 102. The heat exchanger may include any other suitable number of tube assemblies 100.

The tube assemblies are arranged generally vertically such that the central axes of the inner tubes 102 and the outer tubes 104 are generally vertically oriented.

The upper manifold 106 is coupled to a fluid inlet 202 for receiving a fluid from a fluid supply line. The lower manifold 108 is coupled to a fluid outlet 204 for fluid to flow from the lower manifold 108. Fluid that is provided via the fluid inlet 202, flows through the upper manifold 106, through the inner tubes 102, through the lower manifold 108, and out the fluid outlet 204. In this example, the fluid flows downwardly from the upper manifold 106, through the inner tubes 102, and out the lower manifold 108. Alternatively, the fluid inlet may be coupled to the lower manifold and the fluid outlet coupled to the upper manifold such that the fluid flows upwardly from the lower manifold 108, through the inner tubes 102, and out the upper manifold 106. The fluid inlet 202 and the fluid outlet 204 may be flexible connections to accommodate thermal expansion or contraction during use.

The outer tubes 104 are coupled at an upper end thereof to the upper header 110 and at a lower end thereof to the lower header 112. Thus, the outer tubes 104 extend between the upper header 110 and the lower header 112 and fluidly couple the two. The lower header 112 includes an inlet 210 for receiving a second fluid from a second fluid supply line. The upper header 110 includes an outlet 212 for the flow of the second fluid out of the heat exchanger 200. Thus, the second fluid enters the lower header 112 via the inlet 210, flows via capillary action through the annular space or gap 114, and out through the upper header 110. The inlet 210 and the outlet 212 may be flexible connections to accommodate thermal expansion or contraction in use.

As indicated above with reference to FIG. 1, the inner tube 102 and the outer tube 104 are generally concentric and the inner tube 102 is sized relative to the outer tube 104 to provide the annular space or gap 114 that is generally uniform around the inner tube 102 and along the length of the outer tube 104. The annular space or gap 114 is sized to facilitate capillary action fluid flow upwardly through the lower header 112, through the annular space or gap 114, and into the upper header 110.

The gap size is dependent on temperature. For example, the outer tube may have a diameter of about 1" (25 mm) to about ¼" (6.35 mm). A gap of approximately ¼" (6.35 mm) to about 1/16" (1.5875 mm) exists around the inner tube 102, between the inner tube 102 and the outer tube 104.

In this example, the first fluid flow countercurrent to the second fluid. In other examples, the fluids flow co-currently.

The heat exchanger 200 includes a housing 240 in which the tube assemblies 100, the upper manifold 106, the lower manifold 108, the upper header 110, and the lower header 112 are contained. The fluid inlet 202 and the fluid outlet 204, which may be flexible connections, extend through the housing 240 to facilitate connection for fluid flow into the upper manifold 106 and out of the lower manifold 108. The inlet 210 and the outlet 212 may also be flexible connections, and extend through the housing 240 to facilitate connection for fluid flow into the lower header 112 and out of the upper header 110.

In the example shown in FIG. 2, there are no fins surrounding the outer tube 104 and extending outwardly therefrom. Fins may be utilized, however, as such fins may be useful for promoting heat exchange, for example, in use in solar heating.

The second fluid that flows by capillary action from the lower header 112, through the annular space or gap 114, and into the upper header 110 indirectly exchanges heat through the wall of the inner tube 102 with the first fluid that flows through the inner tube 102 and exchanges heat through the wall of the outer tube 104 with the surrounding environment, which may be, for example, a fluid which may be a gas such as air or a liquid such as water, or may be a surrounding material, for example, in a solar panel heat exchanger. In addition, the heat exchanger is scalable as any suitable number of tube assemblies may be utilized for heat exchange and more than one bank of such tube assemblies may be utilized. Heat exchangers employing such tube assemblies may be successfully implemented in various different applications.

The upper and lower headers 110, 112 and the outer tubes 104 are coupled together in a closed loop. The upper and lower headers 110, 112 may be connected together or may be connected in series with other banks of tubes such that multiple banks are included in the closed loop. The fluid in the closed loop may be saturated steam that is heated and reheated in the loop, maintaining the heat within the system and reducing unwanted heat loss as the fluid is recirculated.

Figure 3:
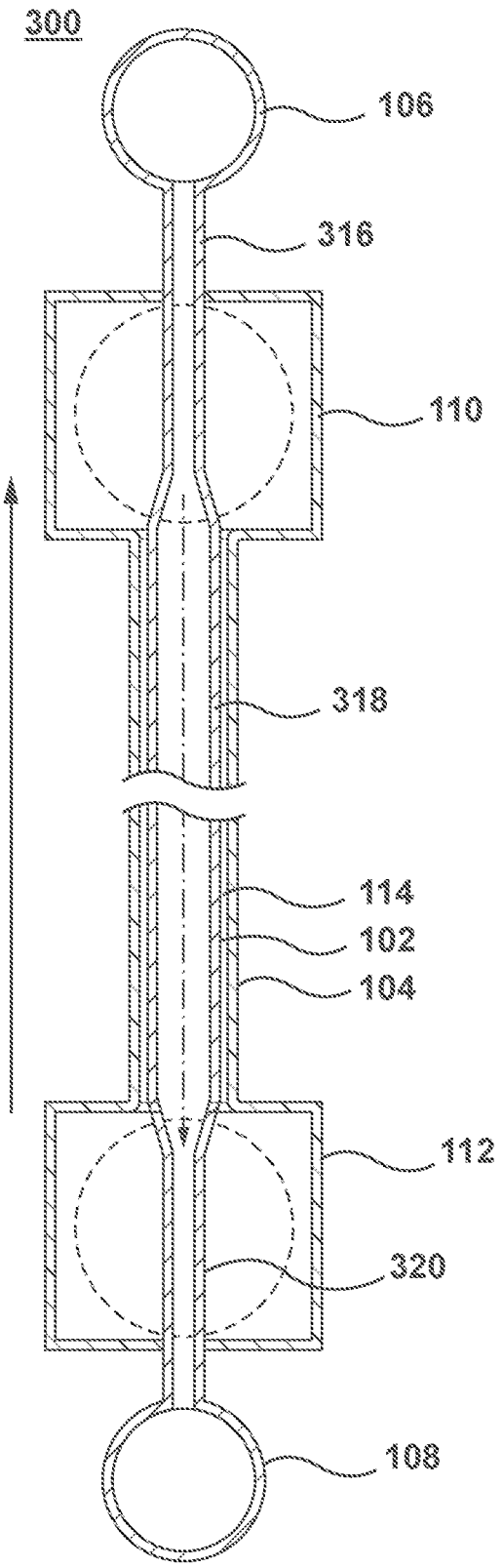
FIG. 3 is a section view through a tube assembly of a heat exchanger in accordance with an aspect of another embodiment.

FIG. 1 shows an example of a tube assembly for use in a heat exchanger. Other tube assemblies may be implemented, however. FIG. 3 shows another example of a tube assembly for use in a heat exchanger in accordance with another aspect of the present disclosure. The tube assembly is indicated generally by the numeral 300. Many of the features and elements of the tube assembly 300 are similar to those shown and described above with reference to FIG. 1 and are therefore not described again herein in detail.

Similar to the tube assembly shown in FIG. 1, the tube assembly of FIG. 3 includes an inner tube 102 fluidly connected to a fluid supply 106 and a fluid receiver 108, and outer tube 104 coupled to an upper header 110 and a lower header 112.

In the present example, however, the inner tube 102 includes three sections, including a first section 316, a second section 318, and third section 320. The first section 316 and the third section 320 are smaller in diameter than the middle, second section 318. The first section 316 and the third section 320 may be similar or equivalent in diameter.

Thus, the inner tube 102 includes two changes in diameter that may be utilized to slow or control the flow of fluid through the inner tube. The larger diameter middle or second section 318 extends through the outer tube 104. The transition from the larger diameter second section 318 to the smaller diameter first section 316 is located above the second section 318 and above the part of the inner tube 102 that is surrounded by the outer tube 104. Thus, the transition to the smaller diameter first section 316 is located in a portion of the upper header 110 and the smaller diameter first section 316 extends from a top thereof. The transition from the larger diameter second section 318 to the smaller diameter third section 320 is located below the second section 318 and below the part of the inner tube 102 that is surrounded by the outer tube 104. Thus, the transition to the smaller diameter third section 320 is located in a portion of the lower header 112 and the smaller diameter third section 320 extends from a bottom thereof.

As in the example described and shown in FIG. 1, the inner tube 102 and the outer tube 104 are generally concentric and the larger diameter second section 118 of the inner tube 102 is sized relative to the outer tube 104 to provide an annular space or gap 114 between an outer surface of the inner tube 102 and an inner surface of the outer tube 104. Because the inner tube 102 and the outer tube 104 are generally concentric, the annular space or gap 114 is generally uniform around the larger diameter second section 118 of the inner tube 102 and along the length of the outer tube 104. The annular space or gap 114 is sized to facilitate capillary action fluid flow upwardly through the lower header 112, through the annular space or gap 114, and into the upper header 110.

Figure 4:
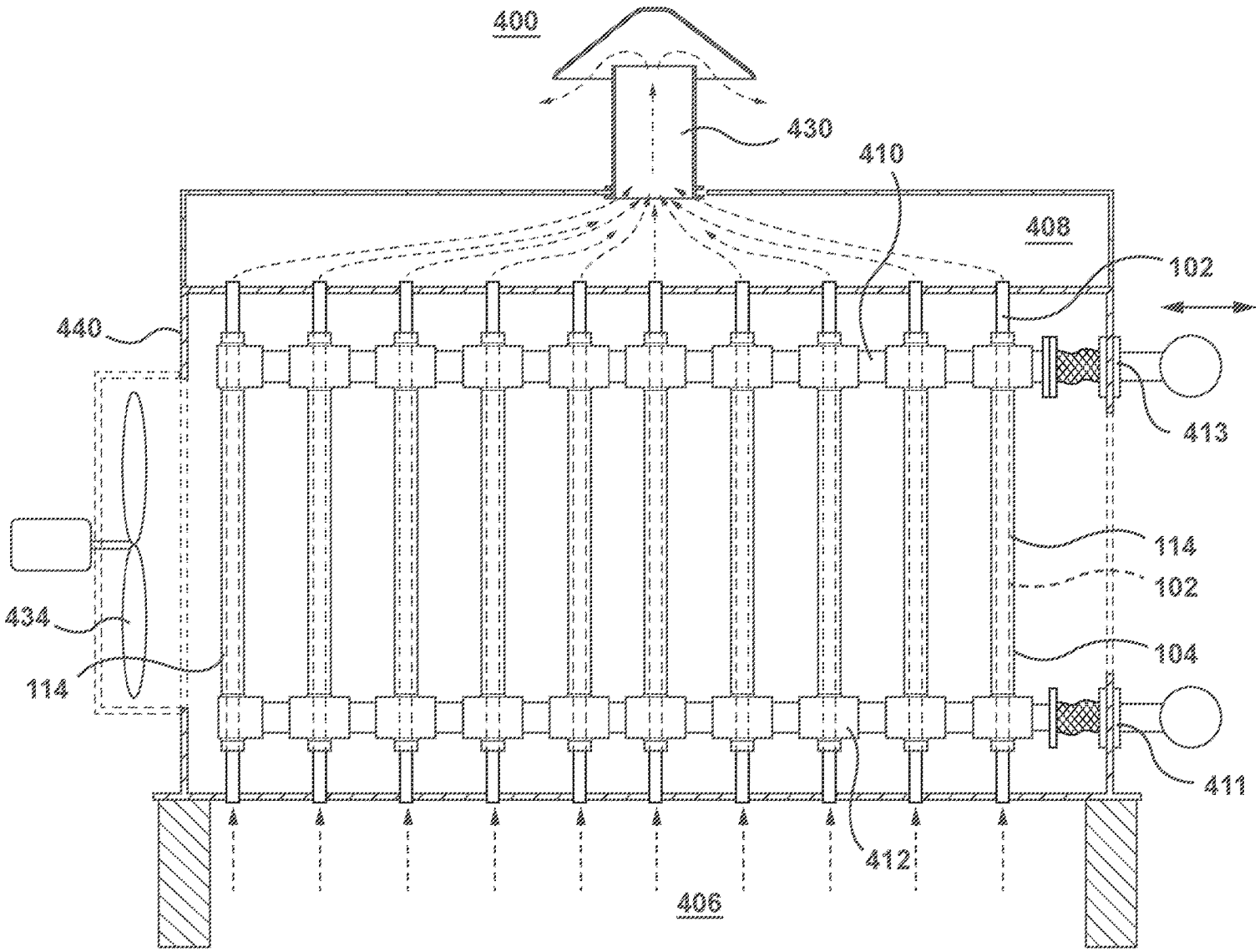
FIG. 4 is a partial sectional front view of a heat exchanger in accordance with an aspect of another embodiment.

Referring now to FIG. 4, a partial sectional front view of another heat exchanger 400 including tube assemblies is illustrated. For this example, 10 tube assemblies are shown. The tube assemblies in the present example may be similar to the tube assemblies 100 shown and described in relation to FIG. 1. The same reference numbers are used to refer to the tube assemblies of FIG. 4 for the purpose of clarity.

Several rows, also referred to as banks of such tube assemblies 100 may be utilized and each row may include any suitable number of tube assemblies 100. In this example, the fluid supply that is coupled to a bottom end of each of the inner tubes 102 is a gas inlet plenum 406. The fluid receiver that is coupled to a top end of each of the inner tubes 102 is an exhaust plenum 408. Thus, in the present example, the medium that flows through the inner tubes 102 is a gas rather than a liquid.

For the purpose of this example, the fluid supply, which is the gas inlet plenum 406, may be coupled to a gas source such as an exhaust gas from a biomass boiler to utilize the heat from the exhaust gases. The fluid receiver, which is the exhaust plenum 408, may be coupled to a chimney 430 or other suitable exhaust device. The inner tubes 102 may be constant diameter or may have different sections with differing diameters as described above with reference to the examples shown in FIG. 1 and FIG. 3.

The outer tubes 104 are coupled at an upper end thereof to the upper header 410 and at a lower end thereof to the lower header 412. Thus, the outer tubes 104 extend between the upper header 410 and the lower header 112 and fluidly couple the two. The lower header 412 includes an inlet 411 for receiving a second fluid from a second fluid supply. The upper header 410 includes an outlet 413 for the flow of the second fluid out of the heat exchanger 400. Thus, the second fluid enters the lower header 412 via the inlet 411, flows via capillary action through the annular space or gap 114, and out through the upper header 410. The inlet 411 and the outlet 413 may be flexible connections to accommodate thermal expansion or contraction when the heat exchanger 400 is in use.

As in the examples described above, the inner tube 102 and the outer tube 104 are generally concentric and the inner tube 102 is sized relative to the outer tube 104 to provide the annular space or gap 114 that is generally uniform around the inner tube 102 and along the length of the outer tube 104. The annular space or gap 114 is sized to facilitate capillary action fluid flow upwardly through the lower header 412, through the annular space or gap 114, and into the upper header 410. As in the above-described examples, the outer tube may have an outer diameter of about 1" (25 mm) to about ¼" (6.35 mm). A gap of approximately ¼" (6.35 mm)

to about 1/16" (1.5875 mm) exists around the inner tube 102, between the inner tube 102 and the outer tube 104.

Although not shown in FIG. 4, fins that extend around the outer tube 104 and extend outwardly therefrom may be utilized to promote indirect heat exchange between the fluid flowing by capillary action fluid flow and a surrounding atmosphere.

The heat exchanger 400 also includes a housing 440 in which the tube assemblies 100, the upper header 410, and the lower header 412 are contained. The inlet plenum and the exhaust plenum may be coupled to the housing 440 or may be parts of the housing 440.

A fan 434 is coupled to the housing 440 to move gas, such as air or inert gas for example, around the outer surface of the outer tubes 104 and the fins that extend outwardly from the outer tubes 104. Thus, the fan 434 is utilized for the flow of gas around the outer tubes 104 to promote heat exchange through the walls of the outer tubes 104.

The inlet 411 and the outlet 413, which may be flexible connections, extend through the housing 440 to facilitate connection for fluid flow into the upper header 410 and out of the lower header 412.

In the present example, the fluid that flows by capillary action fluid flow upwardly through the annular spaces or gaps 114 indirectly exchanges heat with the gases from the inlet plenum 406, and indirectly exchanges heat with the gases moved by the fan 434. In an alternative example, the fluid that flows through the annular spaces or gaps 114 may flow upwardly. In the example of a biomass boiler, the gases fed to the inlet plenum 406 include exhaust gas from a biomass boiler that heat is recovered from. The exhaust gas from the biomass boiler travels through the inner tubes 102, into the exhaust plenum 408, and out the chimney 430. A gas, such as air, is heated as the gas is pushed by the fan 434, over the outer tubes 104. The gas may then be utilized to dry a biomass, to heat a greenhouse, or for any other suitable purpose.

As indicated above, several rows of tube assemblies may be utilized and each row may include any suitable number of tube assemblies. Thus, the heat exchanger is scalable as any suitable number of tube assemblies and any suitable number of rows or banks of tube assemblies may be employed. Thus, the heat exchanger may be scaled for the particular application.

The upper and lower headers 410, 412 and the outer tubes 104 are coupled together in a closed loop. The upper and lower headers 410, 412 may be connected together or may be connected in series with other banks of tubes such that multiple banks are included in the closed loop. The fluid in the closed loop may be saturated steam that is heated and reheated in the loop, maintaining the heat within the system and reducing unwanted heat loss as the fluid is recirculated.

Figure 5:
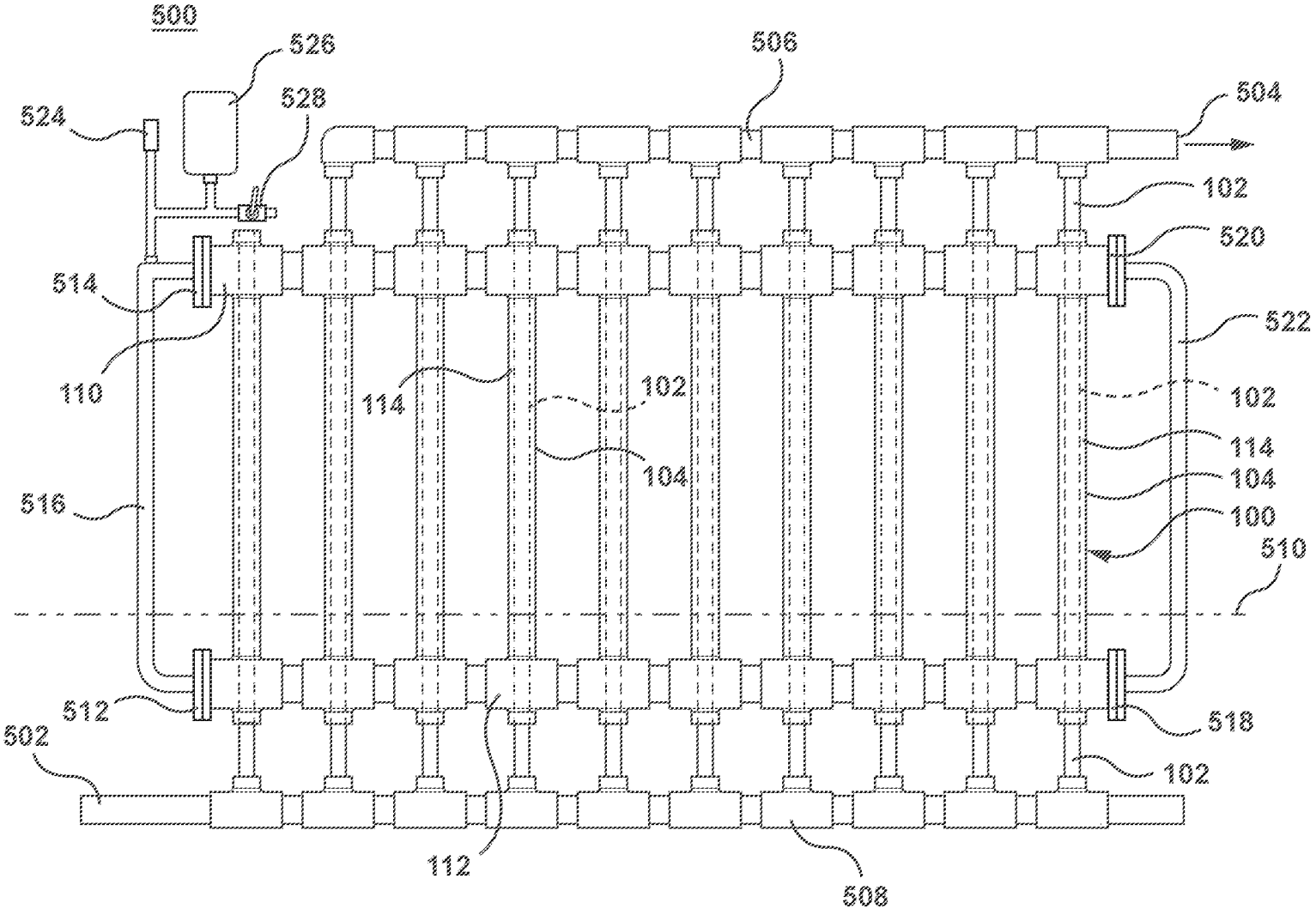
FIG. 5 is a partial sectional front view of a heat exchanger in accordance with an aspect of yet another embodiment.

FIG. 5 shows a front view of a heat exchanger 500 including tube assemblies such as the tube assemblies 100 described with reference to FIG. 1, in accordance with another aspect. The heat exchanger 500 is utilized for solar distilling or desalination of water. In this example, 10 tube assemblies are illustrated. Any suitable number of tube assemblies and rows or banks of tube assemblies may be implemented, however.

As illustrated in FIG. 5, the fluid supply is a lower manifold 508 that is fluidly connected to a bottom end of the inner tubes 102. The fluid receiver is an upper manifold 506 that is fluidly connected to a top end of the inner tubes 102.

The tube assemblies are arranged generally vertically such that the central axes of the inner tubes 102 and the outer tubes 104 are generally vertically oriented.

The lower manifold 508 is coupled to a fluid inlet 502 for receiving a fluid from a fluid supply line, which in this example, is water for distilling or desalination and distilling. The upper manifold 506 is coupled to a fluid outlet 504 for fluid to flow from the upper manifold 506. Fluid that is provided via the fluid inlet 502, flows into the lower manifold 508, and partially fills the inner and outer tubes 102 and 104. A water level indicator 510 is shown in FIG. 5 and indicates a level of the water in the inner tubes 102. The level of the water may differ from that shown, however, and may be adjusted based on height of the tube assemblies 100 and temperature.

The upper manifold 506 is coupled to a fluid outlet 504 for the flow of water from the upper manifold 506. The water that flows from the upper manifold 506 is water from the lower manifold 508 that is heated and vaporized. The water vapor or steam flows through the inner tubes 102, into the upper manifold 506 and may condense and exit the upper manifold via the fluid outlet 504.

The fluid inlet 502 and the fluid outlet 504 may include flexible connections to accommodate thermal expansion or contraction in use.

The outer tubes 104 are coupled at an upper end thereof to the upper header 110 and at a lower end thereof to the lower header 112. Thus, the outer tubes 104 extend between the upper header 110 and the lower header 112 and fluidly couple the two. A first end 512 of the lower header 112 is coupled to a first end 514 of the upper header 110 by a connecting pipe 516. A second end 518 of the lower header 112 is coupled to a second end 520 of the upper header 110 by a second connecting pipe 522. Thus, the ends 512, 518 of the lower header 112 are connected to the ends 514, 520 of the upper header 110. The first connecting pipe 516 is fluidly connected to an air vent 524, an expansion tank 526, and a water fill valve 528 by piping 530.

Utilizing the water fill valve 528 and associated piping 530, the outer tubes 104, the upper header 110, the lower header 112, and the first and second connecting pipes 516, 522 may be filled with water. The air vent 524 facilitates venting of air during filling and in use. The expansion tank 526 accommodates expansion of the water as a result of heating.

The heat exchanger 500 is utilized for solar distillation, desalination or distillation and desalination. The outer tubes 104 of the heat exchanger 500 may be covered by black carbon fiber to facilitate solar heating. The water in the outer tubes 104 flows, by capillary action, through the outer annular space or gap 114 as the water is heated. The water in the outer tubes 104, which may be in the form of saturated steam, continuously flows by thermosiphoning.

The water that flows by capillary action between the upper header 110 and the lower header 112, through the annular space or gap 114, indirectly exchanges heat through the wall of the inner tube 102 with the first fluid that flows through the inner tube 102 and exchanges heat through the wall of the outer tube 104 with the surrounding carbon fiber material. Thus, the water in the annular space or gap 114 is heated by solar heating and heats the water in the inner tubes 102. The heated water vaporizes and the steam flows through the inner tubes into the upper manifold 506 where the steam condenses and exits via the fluid outlet, providing distilled water.

The heat exchanger 500 is scalable as any suitable number of tube assemblies 100 may be utilized for heat exchange.

The upper and lower headers 110, 112 and the outer tubes 104 are coupled together in a closed loop. The fluid in the closed loop may be saturated steam that is heated and reheated in the loop, maintaining the heat within the system and reducing unwanted heat loss as the fluid is recirculated.

Solar thermosiphoning results in continuous recirculation of the saturated steam in the closed loop, which also includes the expansion tank 526. Excess fluid may be released through a lower manifold exit.

Figure 6:
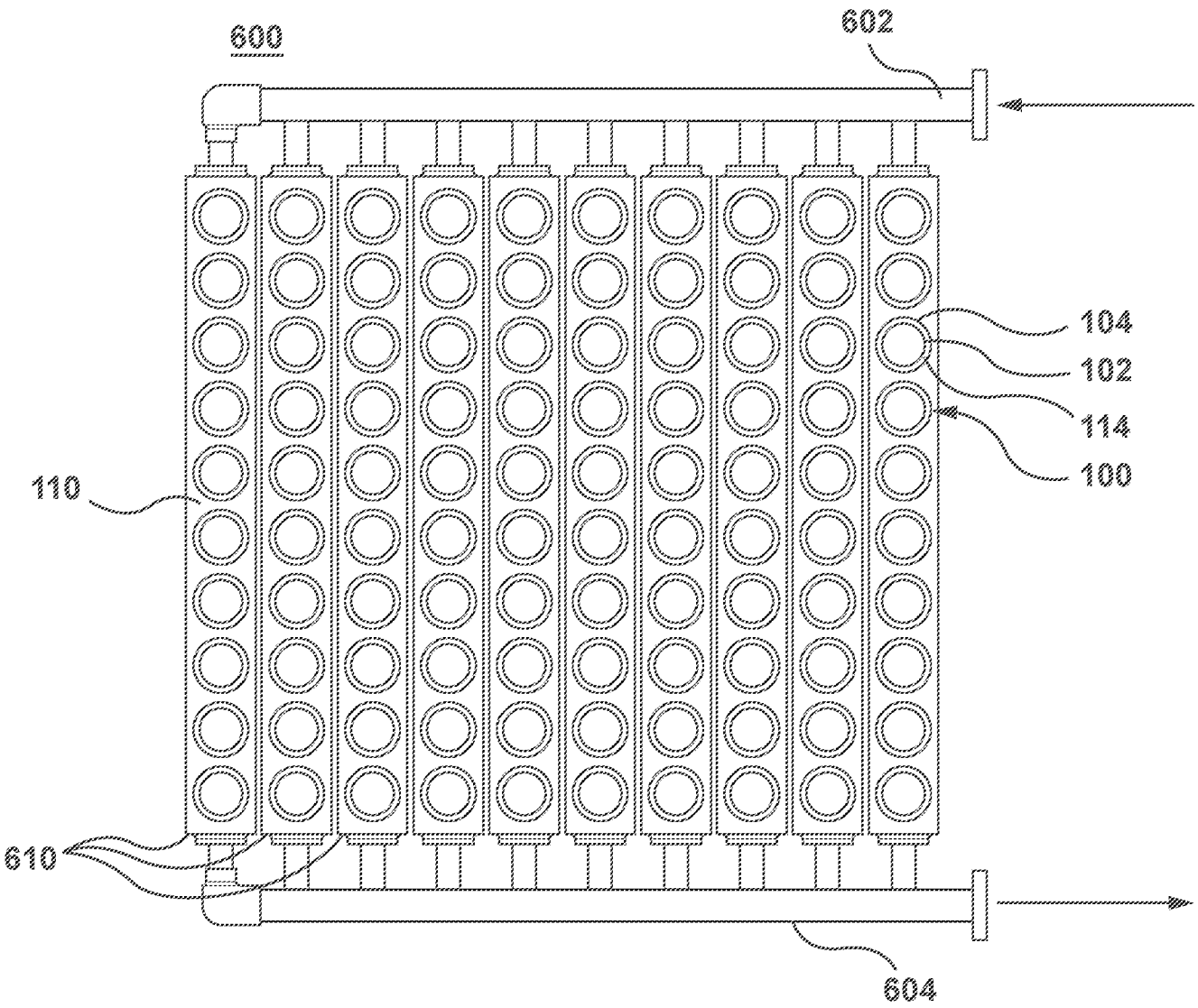
FIG. 6 is a top view of a portion of a heat exchanger in accordance with an aspect of another embodiment.

FIG. 6 shows a top view of a heat exchanger 600 with including tube assemblies such as the tube assemblies 100 described with reference to FIG. 1, in accordance with another aspect. The upper manifold is not shown to more clearly illustrate the inner tube 102 and the outer tube 104 of the tube assemblies 100. The elements of the tube assemblies are similar to those described above with reference to FIG. 1 and are therefore not further described again.

In the present example, the heat exchanger 600 includes 10 banks 610 of tube assemblies 100. Each bank includes an upper header 110 and lower header (shown in FIG. 1) pair. Each bank 610 includes 10 tube assemblies 100 such that an upper end of each outer tube 104 of the 10 tube assemblies 100 of the bank 610 is coupled to the upper header 110 of that bank 610. Similarly, a lower end of each outer tube 104 of the 10 tube assemblies 100 of the bank 610 is coupled to the lower header of the bank 610. The tube assemblies 100 in the bank 610 extend vertically and parallel to each other between the upper header 110 and the lower header of the bank.

The banks 610 are adjacent and in contact with each other. Thus, the upper header 110 and lower header of each bank 610 are adjacent and in contact with an upper header 110 of an adjacent bank 610. Similarly, the lower headers of each bank extend parallel to each other and each lower header is adjacent and in contact with the lower header of an adjacent bank 610.

The diameter of each outer tube 104 is smaller than the width of each of the upper headers 110. Similarly, the diameter of each outer tube 104 is smaller than the width of each of the lower headers. Thus, although each upper header 110 is in contact with one or two adjacent upper headers 110, and each lower header is in contact with one or two adjacent lower headers, each of the outer tubes 104 is spaced from the other outer tubes 104 in adjacent banks 610. The outer tubes 104 are spaced apart to facilitate indirect heat exchange between the fluid in the outer tubes 104 and a surrounding medium, which may be air, water, or any other suitable medium.

In the present example, the 10 banks 610 form a 10 by 10 array of tube assemblies 100. The upper headers 110 of the banks 610 are each fluidly connected to an upper header supply pipe 602 to provide fluid into each of the upper headers 104. The lower headers are each fluidly connected to a lower header return pipe 604 to receive fluid from each of the lower headers. Alternatively, the lower headers may be fluidly connected to a header supply pipe and the upper headers 104 connected to a header return pipe.

The inner tubes 102 may be coupled to pairs of upper and lower manifolds such that each bank includes an upper manifold and a lower manifold with the 10 inner tubes 102 of the bank extending between each pair of manifolds. The manifolds are coupled to a fluid source and a fluid receiver for the flow of fluid into one of each pair of upper and lower manifolds, through the inner tubes 102, and out via the other of each pair of upper and lower manifolds.

The banks 610 of the heat exchanger 600 may bolted or clamped together to maintain the banks together with the upper headers 110 in contact with each adjacent upper header 110 and the lower headers in contact with each adjacent lower header. For example, clamps may be utilized around the entire bank of upper headers.

Although each bank 610 is shown with 10 tube assemblies 100 extending between a pair of upper and lower headers, any suitable number of tube assemblies 100 may extend between each pair of upper and lower headers. In addition, any suitable number of banks may be successfully implemented. The length of the tube assemblies 100 in the banks may be dependent on the heat exchange application to facilitate heat exchange. Thus, the number of banks, the number of tube assemblies 100 in each bank, and the length of the tube assemblies may be identified to facilitate heat exchange depending on the particular application.

The banks 610 may be removable for maintenance or replacement. The bolts or clamps utilized maintain the banks together are removable or may be disconnected and the upper header 104 of any bank 610 may be disconnected from the upper supply pipe 602. Similarly, the lower header of any bank 610 may be disconnected from the lower header return pipe 604. Thus, fluid connections for the bank may be disconnected such that the bank 610 is removable from the set of banks.

Figure 7:
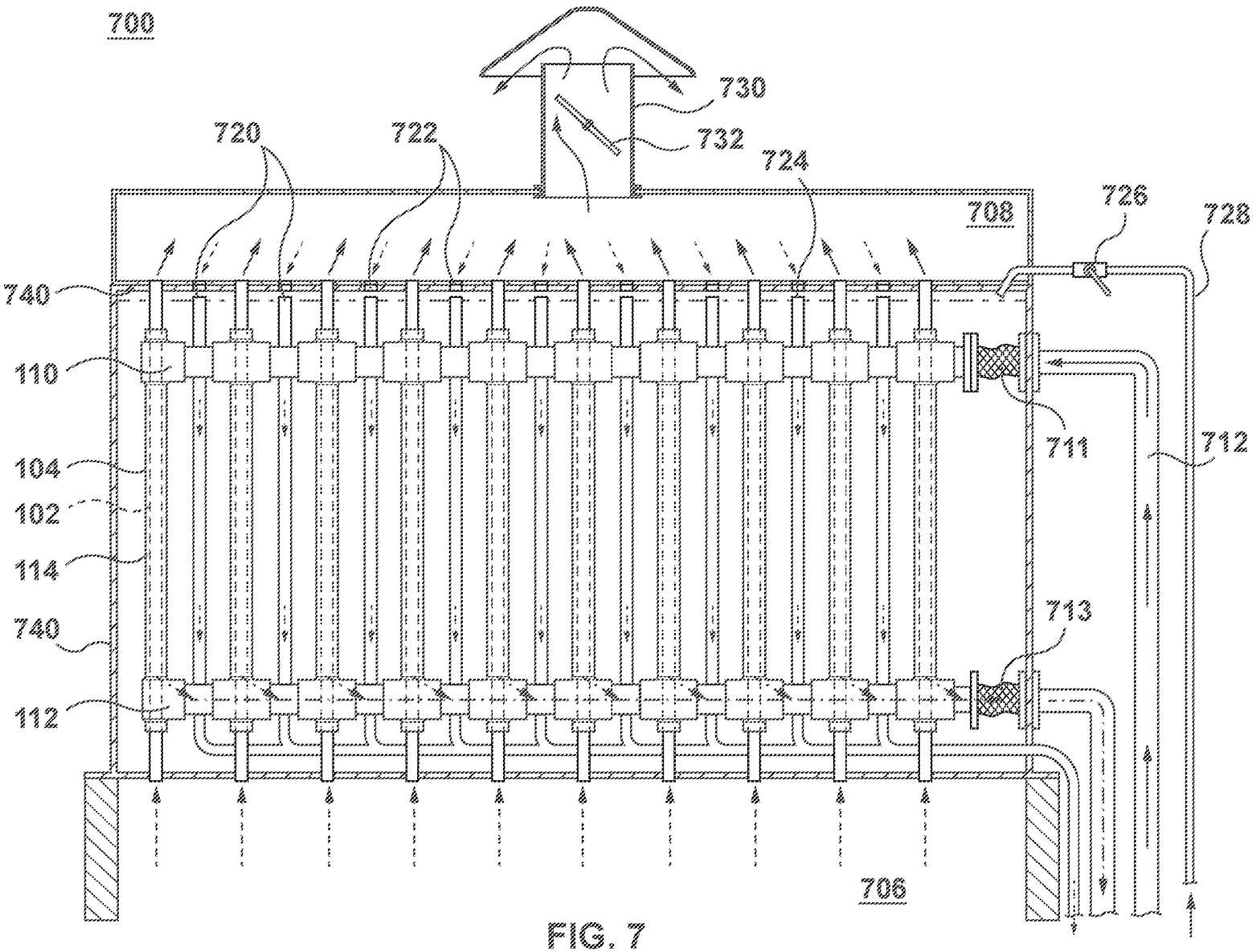
FIG. 7 is a partial sectional front view of a heat exchanger in accordance with an aspect of still another embodiment.

Referring now to FIG. 7, yet another example of a heat exchanger 700 is shown. The heat exchanger 700 is utilized for heat recovery and treatment of exhaust gasses from a cement plant, for example. Although 10 tube assemblies 100 are shown in a single row or bank in FIG. 7, any suitable number of tube assemblies 100 may be utilized. In addition, several rows or banks of such tube assemblies 100 may be utilized and each row or bank may include any suitable number of tube assemblies.

In this example, the fluid supply that is coupled to a bottom end of each of the inner tubes 102 is a gas inlet plenum 706 which receives gases from, for example, a smoke stack of the cement plant. The fluid receiver that is coupled to a top end of each of the inner tubes 102 is an exhaust plenum 708. Thus, the fluid that flows through the inner tubes 102 is a gas rather than a liquid.

The exhaust plenum 708 may be coupled to a chimney 730 or other suitable exhaust device. The inner tubes 102 may be constant diameter or may have different sections with differing diameters as described above with reference to the examples shown in FIG. 1 and FIG. 3.

The outer tubes 104 are coupled at an upper end thereof to the upper header 110 and at a lower end thereof to the lower header 112. Thus, the outer tubes 104 extend between the upper header 110 and the lower header 112 and fluidly couple the two. The upper header 110 includes an inlet 711 for receiving a second fluid from a second fluid supply 712. The lower header 112 includes an outlet 713 for the flow of the second fluid out of the heat exchanger 700. Thus, the second fluid enters the upper header 110 via the inlet 711, flows through the annular space or gap 114, and out through the upper header 110. The inlet 711 and the outlet 713 may be flexible connections to accommodate thermal expansion or contraction when the heat exchanger 700 is in use.

As in the examples above, the inner tube 102 and the outer tube 104 are generally concentric and the inner tube 102 is sized relative to the outer tube 104 to provide the annular space or gap 114 that is generally uniform around the inner tube 102 and along the length of the outer tube 104. The annular space or gap 114 is sized to facilitate capillary action fluid flow through the upper header 110, through the annular space or gap 114, and into the lower header 112.

The heat exchanger 700 is housed in a housing 740 in which the tube assemblies 100, the upper header 110, and the lower header 112 are contained. The inlet plenum 706 and the exhaust plenum 708 may be coupled to the housing 740 or may be parts of the housing 740.

The inlet 711 and the outlet 713 may be flexible connections, and extend through the housing 740 to facilitate connection for fluid flow into the upper header 110 and out of the lower header 112.

A second bank or row of tubes 720 is also utilized. The second row of tubes 720 also extend vertically within the housing 740 and each tube 720 of the second row is generally parallel to and spaced from the tube assemblies 100. Although 10 tubes 720 are shown in a single row in FIG. 7, any suitable number of such tubes 720 may be utilized. In addition, several rows of such tubes 720 may be utilized. Each of the tubes 720 is aligned with an aperture 722 in the exhaust plenum 708 to facilitate the flow of the exhaust from the exhaust plenum, through the aperture and into the housing 740.

Each of the tubes 720 of the second row is fluidly coupled at a lower end thereof to an outlet header that receives fluid from the tubes 720 and drains the fluid into an outlet pipe. The outlet header is located behind the lower header 112 and the outlet pipe is fluidly connected to the outlet header, for example, by a flexible connection. An upper end 724 of each of the tubes 720 is open within the housing 740 and may be supported by a tube sheet or other support within the housing 740. The upper end 724 of each of the tubes 720 is located below the top of the housing 740 such that each of the tubes 720 terminates below the exhaust plenum 708, in alignment with a respective aperture 722.

The housing is filled with water up to the level of the upper ends 724 of the tubes 720. A valve system 726 and water line 728 is coupled to a water supply and utilizes a float system to maintain the level of the water in the housing 740 at the level of the upper ends 724 of the tubes 720.

The gases fed to the inlet plenum 706 are exhaust gas from a cement plant and from which heat is recovered. The exhaust gas travels through the inner tubes 102, into the exhaust plenum 708. The gases from the exhaust plenum are forced from the exhaust plenum 708, down through the apertures 722 in the housing 740 and into the tubes 720. Excess exhaust gases may exit through the chimney 730 that includes an outlet damper 732 that controls the exhaust of gasses out the chimney 730.

The gases that are forced down through the apertures 722 in the housing 740 and into the tubes 720 mix with water in the tubes 720 and carbon dioxide and particulates are trapped and absorbed into the water. The water including absorbed carbon dioxide and particulates flow from the tubes 720 of the second row, to the drain. Carbon dioxide and particulates are collected from the water.

In use, the water that flows through the annular spaces or gaps 114 indirectly exchanges heat with the gases from the inlet plenum 706 and indirectly exchanges heat with the fluid, which is water surrounding the outer tubes 104.

The upper and lower headers 110, 112 and the outer tubes 104 are coupled together in a closed loop. The upper and lower headers 110, 112 may be connected together or may be connected in series with other banks of tubes such that multiple banks are included in the closed loop. The fluid in the closed loop may be saturated steam that is heated and reheated in the loop, maintaining the heat within the system and reducing unwanted heat loss as the fluid is recirculated.

Figure 8:
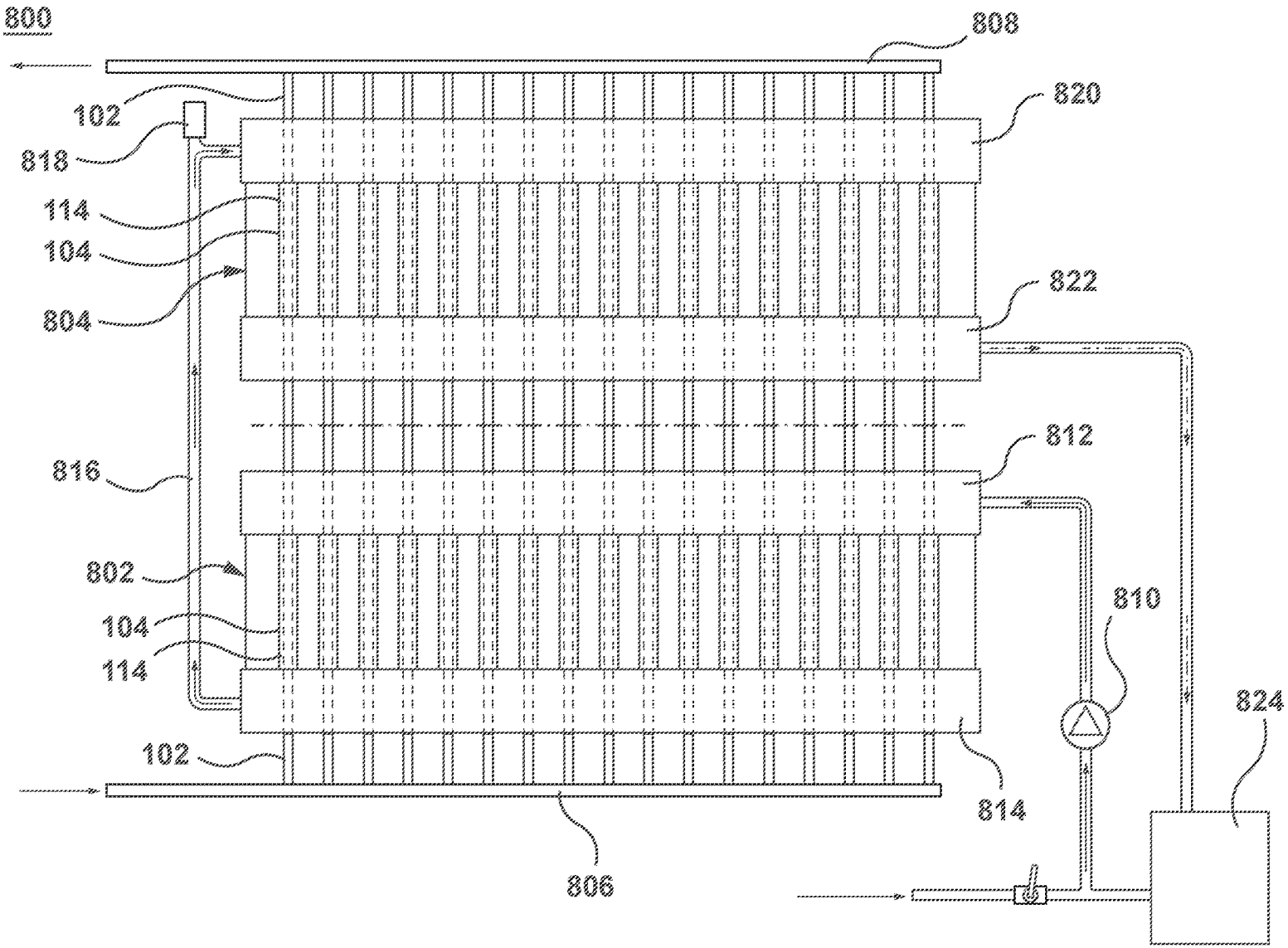
FIG. 8 is a front view of a heat exchanger in accordance with an aspect of another embodiment.

FIG. 8 shows yet another heat exchanger 800, which in this example is solar steam generator for use in power generation. The heat exchanger 800 includes two heat exchange sections 802, 804, each with a set of tube assemblies, which may be similar to those described above with reference to FIG. 1. Both heat exchange sections 802, 804 utilize solar heating.

In the example shown in FIG. 8, however, the condensate water is provided to a lower manifold 806 of the lower heat exchange section 802 and the water enters the inner tubes 102 of the lower heat exchange section 802 where the water is heated to provide saturated steam that travels upwardly through the inner tubes 102 of the lower heat exchange section 802, The inner tubes 102 of the lower heat exchange section 802 are fluidly coupled to the inner tubes 102 of the upper heat exchange section 804 by, for example, unions or flanges that may include expansion joints, and the steam travels upwardly to the upper heat exchange section 804 where the steam is further heated to provide high temperature steam that travels into a high temperature steam manifold 808. The high temperature steam is then utilized, for example, for power generation using a turbine.

The outer tubes 104 of the lower heat exchange section 802 may be covered by black carbon fiber to facilitate solar heating. Similarly, the outer tubes 104 of the upper heat exchange section 804 may be covered by black carbon fiber to facilitate solar heating.

Hot water, which may be in the form of saturated steam, circulates through the outer tubes 104 of both the lower heat exchange section 802 and the upper heat exchange section 804 as water is fed via a circulating pump 810 into an upper header 812 through which the outer tubes 104 of the lower heat exchange section 802 receive the hot water. The water flows downwardly through the annular space or gap 114 and exchanges heat with the fluid that flows in the inner tube 102 of the lower heat exchange section 802 and with the surrounding black carbon fiber heated by solar heating. The water flows into a lower header 814, which is fluidly connected by a connecting pipe 816 to an upper header 820 of the upper heat exchange section 804. An air vent 818 at the top of the connecting pipe 818 may be utilized to facilitate venting of air during filling and in use. Thus, the water from the lower header 814 flows through the connecting pipe 816 and into the upper header 820 of the upper heat exchange section 804. The water then flows into the outer tubes 104 of the upper heat exchange section 804 and downwardly through the annular space or gap 114 as the water exchanges heat with the fluid that flows in the inner tube 102 of the upper heat exchange section 804 and with the surrounding black carbon fiber heated by solar heating. The circulating water is collected in a lower header 822 of the upper heat exchange section 804 and to a tank 824 from which the water is circulated again. As indicated, the water may be in the form of saturated steam that circulates through the heat exchanger. The steam, including condensed water, is circulated back to the tank 824 and recirculated.

As with the examples described above, the heat exchanger 800 is scalable as any suitable number of tube assemblies may be utilized in the two heat exchange sections and any suitable length of the tube assemblies may be utilized to facilitate the heat exchange.

Figure 9:
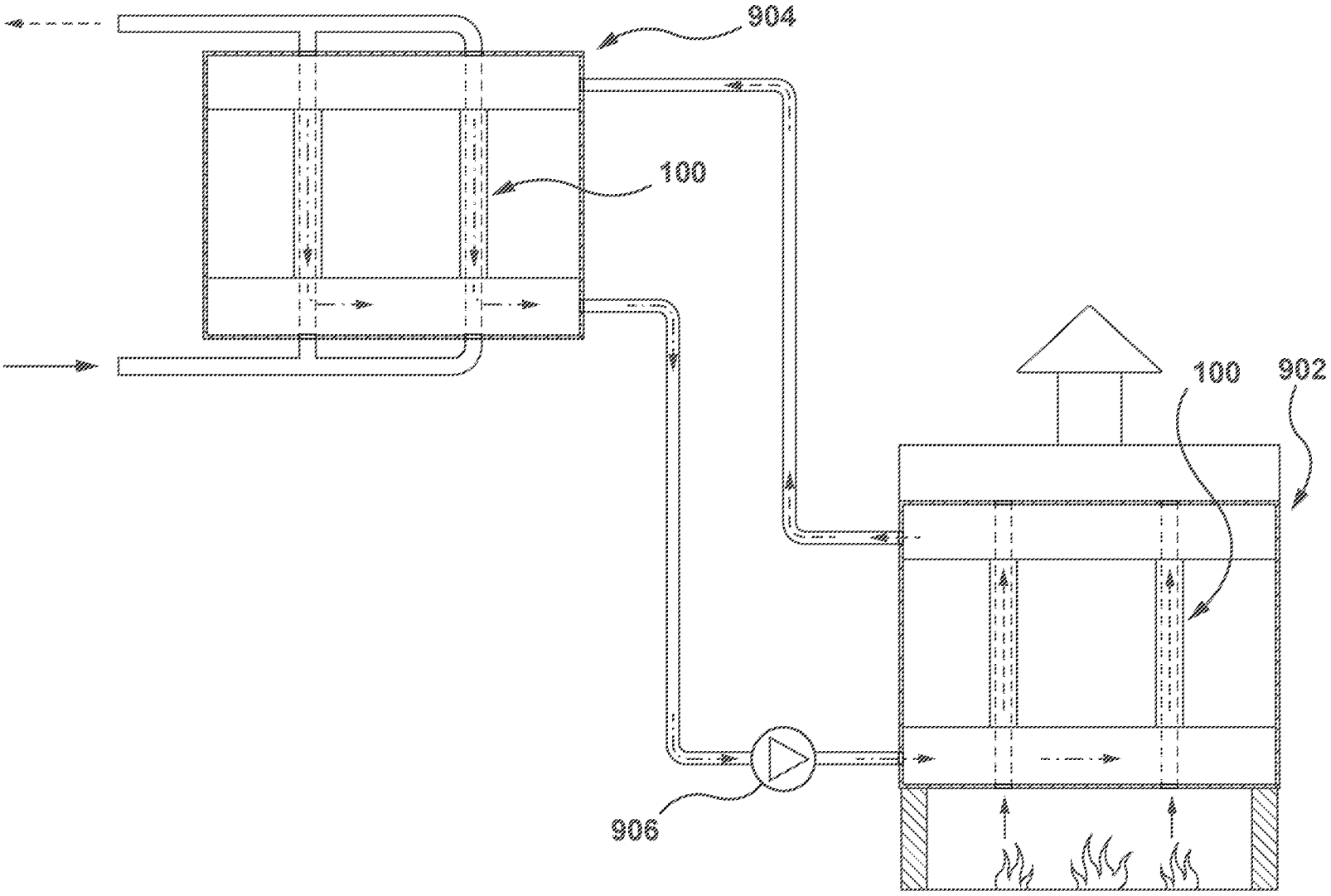
FIG. 9 is a front view and partial sectional front view of heat exchangers in accordance with an aspect of still another embodiment.

FIG. 9 shows heat exchangers including a biomass boiler heat exchanger 902 and a solar panel heat exchanger 904 for use in generating steam for power generation, for example. Many of the elements of each of the biomass boiler heat exchanger 902 and the solar panel heat exchanger 904 are similar to those described in the examples above and therefore these elements are not further described again in detail. The heat exchangers illustrated in FIG. 9 are shown as a schematic illustration and are not to scale. It will be understood that these heat exchangers may be much larger and the relative size of the heat exchangers may be significantly different than shown.

Both the biomass boiler heat exchanger 902 and the solar panel heat exchanger 904 include respective tube assemblies 100. The tube assemblies 100 are similar to the tube assemblies shown and described above with reference to FIG. 1. Hot gases from a biomass boiler travel through the inner tubes of the biomass boiler heat exchanger 902, heating the fluid, which in this example is saturated steam, moving upwardly by capillary action through the outer tubes. The saturated steam is then fed to the solar panel heat exchanger 904. The saturated steam flows downwardly by capillary action, through the outer tubes of the solar panel heat exchanger 904 and is circulated back to the biomass boiler heat exchanger 902 using a circulating pump 906. Solar heating heats the water as the water flows through the outer tubes of the solar panel heat exchanger 904.

Water in the inner tubes of the solar panel heat exchanger 904 is heated and the resulting saturated steam is utilized for power generation. The water may be condensate return water from the saturated steam.

In this example, the biomass boiler heat exchanger 902 may be utilized when the sun is not providing sufficient heating to produce the saturated steam. When sufficient heating is provided by the sun, the biomass boiler is not utilized.

The tube assemblies may be utilized in many other heat exchanger applications and in different configurations and combinations.

Advantageously in each of the above-described examples, the second fluid, which is in the outer tube and that flows by capillary action through the annular space or gap, indirectly exchanges heat through the wall of the inner tube 102 with the first fluid that flows through the inner tube 102 and also exchanges heat through the wall of the outer tube 104 with the surrounding environment, which may be, for example, a fluid which may be a gas such as air or a liquid such as water, or may be a surrounding material, for example, in a solar panel heat exchanger. In addition, the heat exchanger utilizing these tube assemblies is scalable as any suitable number of tube assemblies in any suitable number of rows or banks may be utilized for heat exchange. Heat exchangers employing such tube assemblies may be successfully implemented in various different applications.

In each of the examples, the upper and lower headers and the outer tubes are coupled together in a closed loop. The upper and lower headers may be connected together or may be connected in series with other banks of tubes such that multiple banks are included in the closed loop. The fluid in the closed loop may be saturated steam that is heated and reheated in the loop, maintaining the heat within the system and reducing unwanted heat loss as the fluid is recirculated.

Figure 10:
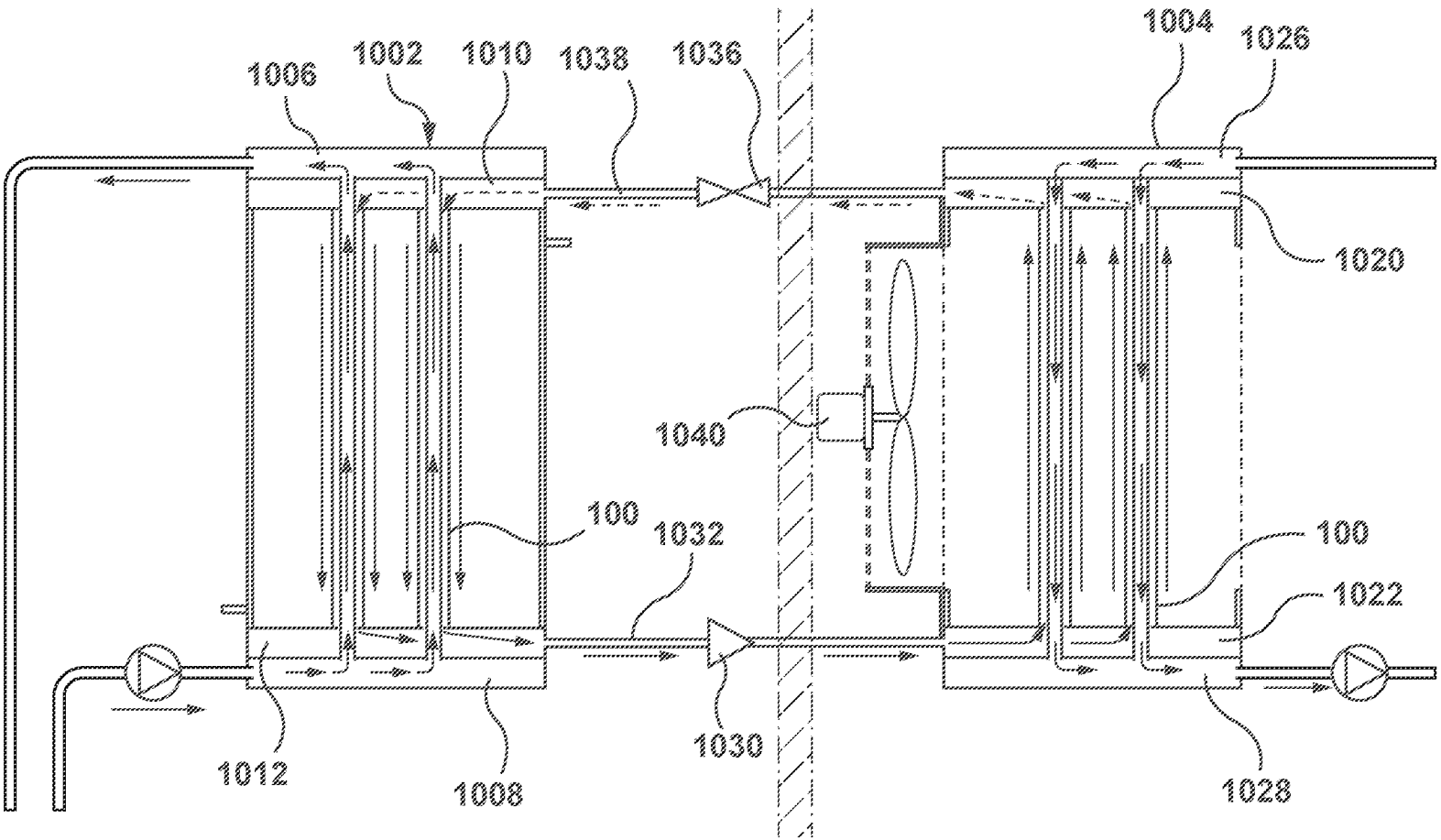
FIG. 10 shows a partial sectional front view of heat exchangers in accordance with an aspect of yet another embodiment.

Referring now to FIG. 10, yet further examples of heat exchangers are shown in schematic form. In this example, the heat exchangers include a condenser 1002 and an evaporator 1004, for use in, for example, heating and air conditioning. Many of the elements of each of the condenser 1002 and the evaporator 1004 are similar to those described in the examples above and therefore these elements are not further described again in detail. Both the condenser 1002 and the evaporator 1004 include respective tube assemblies 100. The tube assemblies 100 are similar to the tube assemblies shown and described above with reference to FIG. 1. Only two tube assemblies 100 are illustrated in each of the condenser 1002 and the evaporator 1004. Each of the condenser 1002 and the evaporator 1004 may include any suitable number of tube assemblies 100 and any suitable number of banks of tube assemblies 100.

The outer tubes of the tube assemblies 100 in the condenser 1002 are coupled at an upper end thereof to the upper condenser header 1010 and at a lower end thereof to the lower condenser header 1012. The inner tubes of the tube assemblies 100 in the condenser 1002 are coupled at an upper end thereof to the upper condenser manifold 1006 and at a lower end to a lower condenser manifold 1008.

The outer tubes of the tube assemblies 100 in the evaporator 1004 are coupled at an upper end thereof to the upper evaporator header 1020 and at a lower end thereof to the lower evaporator header 1022. The inner tubes of the tube assemblies 100 in the evaporator 1004 are coupled at an upper end thereof to the upper evaporator manifold 1026 and at a lower end to a lower evaporator manifold 1028.

The lower header 1012 of the condenser 1002 is fluidly coupled with the lower header 1022 of the evaporator 1004, with a compressor 1030 disposed along the connecting fluid line 1032 between the lower header 1012 of the condenser 1002 and the lower header 1022 of the evaporator 1004.

The upper header 1020 of the evaporator 1004 is fluidly coupled with the upper header 1010 of the condenser 1002, with an expansion valve 1036 disposed along the upper header connecting line 1038 connecting the upper header 1020 of the evaporator 1004 and the upper header 1010 of the condenser 1002.

Refrigerant flows through the closed system that includes the upper headers 1010, 1020, the outer tubes of the tube assemblies 100, the lower headers 1012, 1022, the connecting fluid line 1032, and the upper header connecting line 1038.

The condenser 1002 also includes the upper manifold 1006 and the lower manifold 1008 fluidly coupled by the inner tubes of the tube assemblies 100. The lower manifold 1008 receives, for example, water from a ground source that enters the lower manifold 1008, travels upwardly through the inner tubes of the tube assemblies 100, into the upper manifold 1006 from which the water is discharged or recirculated to the ground source. Thus, the refrigerant in the tube assemblies exchanges heat with the water from the ground source. The housing of the condenser 1002 also includes water or air cooling on the outside of the tube assemblies 100 such that the refrigerant also exchanges heat with the water or air.

The evaporator 1004 also includes the upper manifold 1026 and the lower manifold 1028 fluidly coupled by the inner tubes of the tube assemblies 100 of the evaporator 1004. The upper manifold 1026 receives, for example, water that enters the upper manifold 1026, travels downwardly through the inner tubes of the tube assemblies 100, into the lower manifold 1028 from which the water is discharged or recirculated. Thus, the refrigerant in the tube assemblies exchanges heat with the water from the ground source. In the present example, a fan 1040 is utilized to direct air around the tube assemblies 100 of the evaporator for heat exchange of the air with the refrigerant in the outer tubes of the tube assemblies 100 in the evaporator 1004.

In the example shown in FIG. 10, the heat exchangers, which include the condenser 1002 and the evaporator 1004 are utilized to circulate refrigerant, which may be utilized in a cooling or air conditioning application.

Again, the second fluid, which in this case is refrigerant, flows through the annular space or gap in each heat exchanger and indirectly exchanges heat through the wall of the inner tube with the first fluid that flows through the inner tube and also exchanges heat through the wall of the outer tube, with the surrounding environment.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. A heat exchanger comprising:

a plurality of heat exchange tube assemblies, each heat exchange tube assembly of the heat exchange tube assemblies including an inner tube extending within an outer tube and configured for the flow of a first fluid therein, the inner tube and the outer tube sized to facilitate capillary action fluid flow of a second fluid in an annular space, between an outer surface of the inner tube and an inner surface of the outer tube, facilitating indirect heat exchange between the first fluid and the second fluid, through the inner tube as the second fluid flows by capillary action between the inner tube and the outer tube and the first fluid flows through the inner tube, and indirect heat exchange through the outer tube; and an upper header and a lower header coupled to the outer tube such that the outer tube extends between the upper header and the lower header to provide the second fluid to and receive the second fluid from the outer tube.

2. The heat exchanger according to claim 1, wherein the heat exchange tube assemblies extend generally vertically to facilitate generally vertical flow of the first fluid and the second fluid.

3. The heat exchanger according to claim 2, wherein the inner tube and the outer tube are configured for flow of the first fluid in a direction opposite to a direction of flow of the second fluid.

4. The heat exchanger according to claim 1, comprising a fan for directing a third fluid over the heat exchange tube assemblies, and wherein the third fluid comprises air.

5. The heat exchanger according to claim 1, comprising a plurality of fins extending from the outer tube to promote heat exchange.

6. The heat exchanger according to claim 1, comprising an upper manifold and a lower manifold coupled to the inner tube such that the inner tube extends between the upper manifold and the lower manifold to provide the first fluid to and receive the first fluid from the inner tube.

7. The heat exchanger according to claim 1, comprising a lower plenum and an upper plenum coupled to the inner tube such that the inner tube extends between the upper plenum and the lower plenum to provide the first fluid to and receive the first fluid from the inner tube, and wherein the first fluid comprises a gas.

8. The heat exchanger according to claim 1, comprising a turbulence inducer disposed within the inner tube.

9. A heat exchange tube assembly for use in a heat exchanger, the heat exchange tube assembly comprising:

an inner tube and an outer tube, the inner tube extending within the outer tube and configured for the flow of a first fluid therein, the inner tube and the outer tube sized to facilitate substantially vertical capillary action fluid flow of a second fluid in an annular space, between an outer surface of the inner tube and an inner surface of the outer tube, facilitating indirect heat exchange between the first fluid and the second fluid, through the inner tube as the second fluid flows by capillary action between the inner tube and the outer tube and the first fluid flows through the inner tube, and indirect heat exchange through the outer tube; and a turbulence inducer disposed within the inner tube.

10. The heat exchange tube assembly according to claim 9, comprising a plurality of fins extending from the outer tube to promote heat exchange.

11. A heat exchanger comprising:

a plurality of heat exchange tube assemblies, each heat exchange tube assembly of the heat exchange tube assemblies including an inner tube extending within an outer tube and configured for the flow of a first fluid therein, the inner tube and the outer tube sized to promote capillary action fluid flow of a second fluid in an annular space, between an outer surface of the inner tube and an inner surface of the outer tube;

a first fluid supply coupled to the inner tubes and a first fluid receiver coupled to the inner tubes for the flow of the first fluid through the inner tubes;

a second fluid supply coupled to the outer tubes to supply the second fluid to the outer tubes and a second fluid receiver coupled to the outer tubes to receive the second fluid therefrom;

wherein the tube assemblies are configured to facilitate indirect heat exchange between the first fluid and the second fluid, through a wall of the inner tube as the second fluid flows by capillary action between the inner tube and the outer tube and the first fluid flows through the inner tube, and indirect heat exchange through a wall of the outer tube.

12. The heat exchanger according to claim 11, wherein the first fluid supply and the first fluid receiver comprise manifolds coupled to the inner tube such that the inner tubes extend between the manifolds to provide the first fluid to and receive the first fluid from the inner tube.

13. The heat exchanger according to claim 11, wherein the first fluid supply and the first fluid receiver comprise plenums coupled to the inner tubes such that the inner tubes extend between the plenums to provide the first fluid to and receive the first fluid from the inner tube, and wherein the first fluid comprises a gas.

14. The heat exchanger according to claim 11, wherein the second fluid supply and the second fluid receiver comprises headers coupled to the outer tubes such that the outer tubes extend between the headers.

15. The heat exchanger according to claim 14, wherein the headers and the outer tubes are part of a closed-loop system for recirculating the second fluid through the heat exchanger.

16. The heat exchanger according to claim 14, wherein the headers and the outer tubes are coupled together to recirculate the second fluid through the heat exchanger.

17. The heat exchanger according to claim 11, wherein the second fluid supply and the second fluid receiver comprise portions of a housing.

18. The heat exchanger according to claim 11, wherein the heat exchange tube assemblies extend generally vertically to facilitate generally vertical flow of the first fluid and the second fluid.

19. The heat exchanger according to claim 18, wherein the inner tubes and the outer tubes are configured for flow of the first fluid in a direction opposite to a direction of flow of the second fluid.

20. The heat exchanger according to claim 11, comprising a fan for directing the third fluid over the heat exchange tube assemblies for indirect heat exchange with the second fluid, and wherein the third fluid comprises air.

21. The heat exchanger according to claim 11, comprising a plurality of fins extending from the outer tubes to promote heat exchange.

22. The heat exchanger according to claim 11, wherein the heat exchange tube assemblies include turbulence inducers disposed within the inner tubes.

* * * * *